US006843373B2

(12) United States Patent
Laupan

(10) Patent No.: US 6,843,373 B2
(45) Date of Patent: Jan. 18, 2005

(54) DISPLAY TRAY

(75) Inventor: William R. Laupan, Madison, WI (US)

(73) Assignee: Traex Company, Toledo, OH (US)

( * ) Notice: Subject to any disclaimer, the term of this patent is extended or adjusted under 35 U.S.C. 154(b) by 140 days.

(21) Appl. No.: 10/096,410

(22) Filed: Mar. 11, 2002

(65) Prior Publication Data

US 2002/0174576 A1 Nov. 28, 2002

Related U.S. Application Data

(60) Provisional application No. 60/275,185, filed on Mar. 12, 2001.

(51) Int. Cl.[7] ..... B65D 1/34; B65D 85/00; G09F 3/00

(52) U.S. Cl. ..... 206/562; 206/564; 206/459.5; 40/324

(58) Field of Search ..... 206/564, 565, 206/562, 557, 232, 486, 493, 767, 831, 459.5; 40/324, 124.06, 661, 662, 661.08; D6/310

(56) References Cited

U.S. PATENT DOCUMENTS 1,711,412 A * 4/1929 Hines ..... 206/38
2,069,957 A * 2/1937 Klein ..... 40/324
2,891,695 A * 6/1959 Peters ..... 206/518
2,908,985 A * 10/1959 Hartman ..... 40/324
3,442,378 A * 5/1969 Wolfe ..... 206/564
4,083,453 A * 4/1978 Berger et al. ..... 206/565
D306,529 S * 3/1990 Goodell ..... D6/310
5,429,266 A * 7/1995 D'Oliveira et al. ..... 206/564
D410,452 S * 6/1999 Ancona et al. ..... D6/310
6,430,857 B1 * 8/2002 Nagel ..... 40/661

* cited by examiner

*Primary Examiner*—Mickey Yu
*Assistant Examiner*—J. Gregory Pickett
(74) *Attorney, Agent, or Firm*—MacMillan, Sobanski & Todd, LLC

(57) ABSTRACT

A serving tray has a slot formed in a side wall of the tray into which is received the corner of a shouter card with a friction fit between the card and the slot. Both bottom corners of the card extend through the side wall of the tray at opposite ends of the slot and the shouter card is supported from the bottom by the tray in the middle of the slot. The slot is made of alternating angle segments so that from end to end the slot is straight but a friction fit is created between the slot and the shouter card by the alternating peaks and valleys of the slot for a relatively wide range of shouter card thicknesses.

17 Claims, 7 Drawing Sheets

DISPLAY TRAY

CROSS-REFERENCE TO RELATED APPLICATION

This application claims the benefit of Provisional Patent Application No. 60/275,185, filed on Mar. 12, 2001.

STATEMENT CONCERNING FEDERALLY SPONSORED RESEARCH OR DEVELOPMENT

Not applicable.

FIELD OF THE INVENTION

This invention relates to serving trays of the type that are used in restaurants and taverns.

BACKGROUND OF THE INVENTION

Plastic serving trays, typically round in shape, are common in restaurants and taverns for waiters and waitresses to carry drinks and food items to tables they are serving. The trays are also used for busing dirty dishes and glasses. These trays are typically a disk with a bottom wall and a round (e.g., circular or oval) side wall which is conical so that it diverges upwardly away from the bottom wall. The tray also typically has a lip to make it easier to hold from the sides. The tray may also have a raised ridge on the lower surface of the bottom wall, and a nonskid material adhered or otherwise applied to the upper surface of the bottom wall of the tray.

There is a need to advertise the specials of the day in restaurants and taverns and an effective way of doing that is to do so on serving trays. Previously, advertising cards, sometimes called shouters, have been of the type which would have a small permanent or removable base so that they could stand up, and the shouter could be placed on the tray so that the patrons could see it when a waiter or waitress walked by or set the tray on a table. However, these were prone to being knocked over and were not all that visible since they were on the interior of the tray. The present invention seeks to overcome these disadvantages of prior restaurant and bar tray advertising shouters.

SUMMARY OF THE INVENTION

A tray of the invention has a slot in its edge into which a shouter can be inserted, with the shouter standing upwardly at approximately a right angle to the bottom wall of the tray. Thereby, advertising indicia on the side of the shouter facing away from the tray can be viewed a by patrons. Advertising indicia could also be provided on the side of the shouter facing the tray.

In a preferred form, the slot opens upwardly and has vertical sides, at 90 degrees to the bottom wall of the tray, and from end to end the slot is made up of a number of slots which are joined end to end and alternate in angle, so that overall from end to end the slot follows a straight line, but each segment of the slot is angled. This creates alternating peaks and valleys on opposite sides of the slot, with the peaks of one side extending into the valleys on the other side and the peaks on both sides clamping the base of the shouter between them. Thereby a shouter can be inserted in the slot with a secure friction fit between the base of the shouter and the sides of the slot to hold the shouter securely in the slot. Also, with this connection a wide variety of shouters of different thicknesses, materials and stiffnesses can be supported in the slot.

Thus, the invention provides a tray with an edge mounted shouter or advertising card which is readily visible by patrons of the establishment in which the tray is being used. In addition, since the tray is not an integral part of the advertising card, different cards can be used on different trays, or on different days.

In a preferred form, the tray is round, for example either circular or oval, and the slot is along a chord of the tray at or near the outer edge of the bottom wall of the tray, where the bottom wall intersects the side wall of the tray. Thereby, the slot extends through the side wall of the tray at the ends of the slot and the bottom of the slot is closed in the middle portion of the slot. The shouter is supported from below in the middle portion of the slot, and the lower corners of the shouter extend though the side wall of the tray at the open ends of the slot. This creates a connection which helps hold the shouter upright and makes it easy to insert the shouter in the slot.

These and other objects and advantages of the invention will be apparent from the detailed description and drawings.

DETAILED DESCRIPTION OF THE PREFERRED EMBODIMENTS

Figure 2:
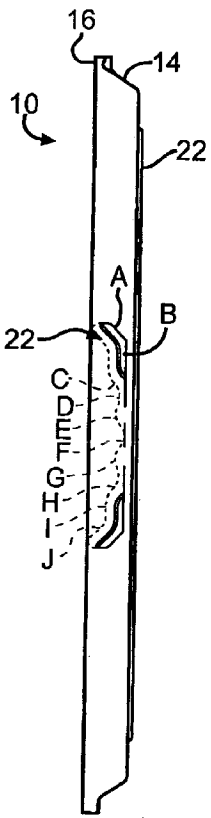
FIG. 2 is a side plan view of the tray of FIG. 1.
Figure 1:
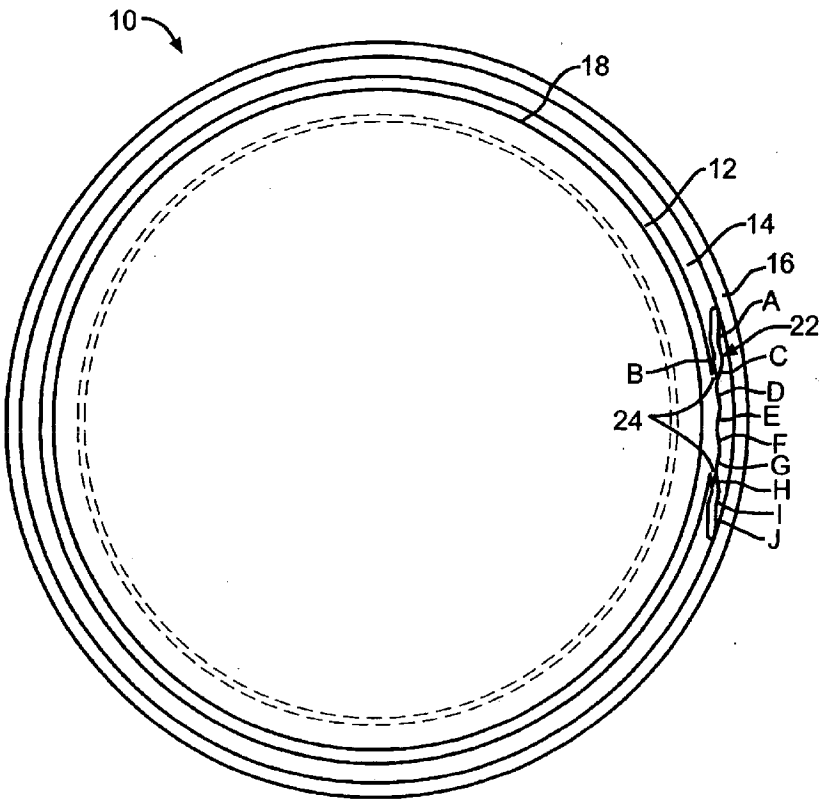
FIG. 1 is a top plan view of a tray having a slot according to the invention.

Referring to FIG. 1, a tray 10 of the invention has a bottom wall 12, an angled side wall 14 which tapers toward the bottom wall 12 so that the side wall 14 is frusto-conical in shape and a rim 16 at the top of the side wall 14. A non-skid pad 18 may also be applied such as with an adhesive, to the top surface of the bottom wall 12. The tray 10 is typically molded plastic, such as polypropylene, ABS, structural foamed plastics, or glass filled thermoset plastics such as polyester or epoxy, and is typically about ⅛ inch thick. In addition, referring to FIG. 2, the tray 10 may have a circular bottom rib 20 on the bottom surface of the bottom wall 12.

Figure 3:
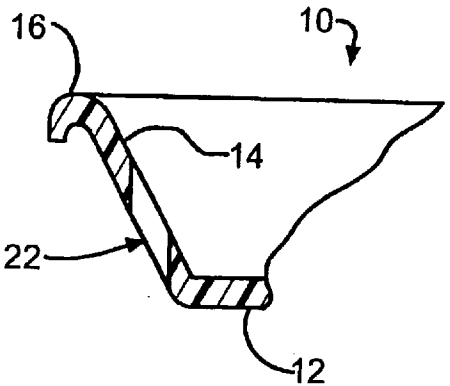
FIG. 3 is a sectional view from the plane of the line 3—3 of FIG. 7.
Figure 4:
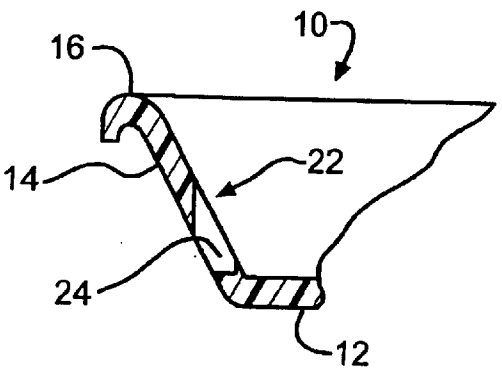
FIG. 4 is a cross-sectional view from the plane of the line 4—4 of FIG. 7.

Cut into the side wall 14 so that it forms a chord of the side wall 14 is a slot 22. The slot 22 is made up of end to end joined segments A–J. The slot 22 may be cut into the side wall 14 by cutting it with a 0.125 inch diameter flat ended milling bit, starting at the top of the inner edge of the rim or lip 16 (so the slot is inside of the rim 16 and closed at its outer ends) and indexing the bit in 0.080 by 0.400 inch increments. In other words, each segment forms the hypotenuse of a right triangle which has one of its right angle sides 0.400 inches long and the other of its right angle sides 0.080 inches long. The angle of each segment A–J alternates from adjacent segment to adjacent segment. Only the three segments at each end of the slot 22, i.e., segments A–C and segments H–J have two sides, which as shown in FIGS. 3 and 4 are at right angles to the bottom wall 12 of the tray. Segments D–G are single sided, only having an outer side. Thus, the segments D–G each present a single wall which confronts the outer surface of the shouter card.

Figure 5:
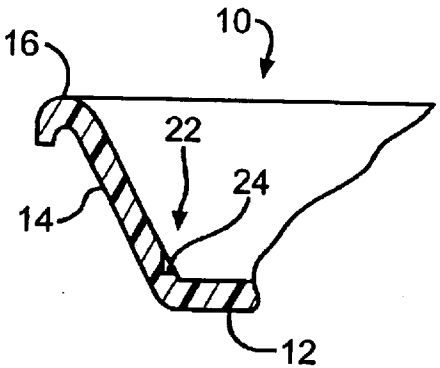
FIG. 5 is a cross-sectional view from the plane of the line 5—5 of FIG. 7.
Figure 6:
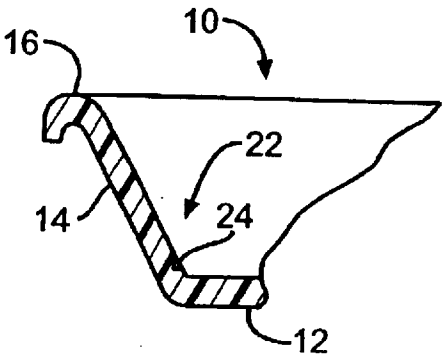
FIG. 6 is a cross-sectional view from the plane of the line 6—6 of FIG. 7, showing the slot extending deeper into the side than in FIG. 5.
Figure 7:
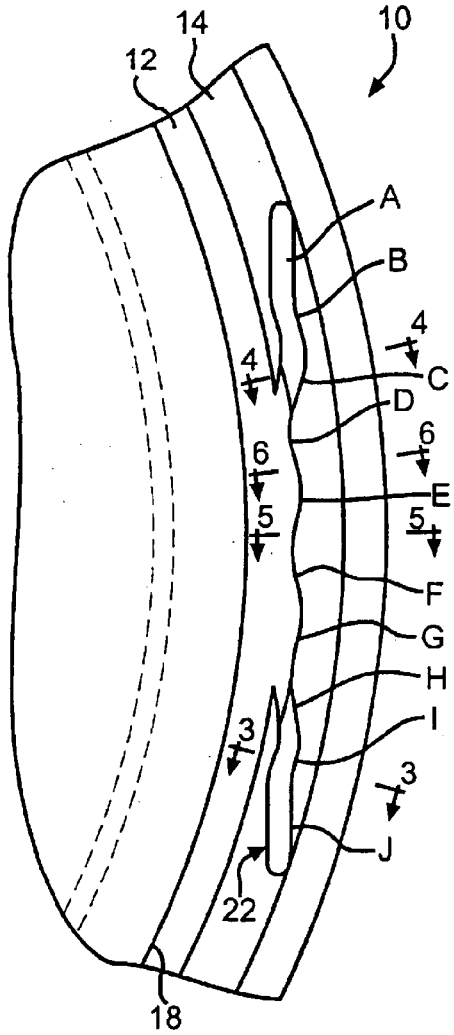
FIG. 7 is a detail view of the slot as viewed from above, as in FIG. 1.

It is noted that as shown in FIG. 1, the base surface 24 of the slot 22 is shown as being flush with the upper surface of the bottom wall 12 of the tray 10. This would be the case if the flat end of the bit used to cut the slot 22 was exactly flush with the upper surface of the bottom wall 12. However, as shown in FIGS. 4, 5, and 6, this need not necessarily be the case. As shown in those figures, the base surface 24 of the slot 22 may be slightly above the bottom wall 12 of the tray 10, as would be the case if the flat end of the bit was a similar distance above the upper surface of the bottom wall 12.

The chord of the tray 10 along which the slot 22 runs is chosen to be at the edge of the bottom wall 12 so that the middle section of the slot 22 only has an outer side. In other words, the inner sides of the sections D–G in the middle of the slot 22 are missing, because the wall 14 runs out at or near the inner ends of the sections C and H. This provides the base 24 of the slot 22, which may be at, above or below the level of the upper surface of the bottom wall 12 of the tray, to support the bottom of the shouter card.

As shown in the figures, the ends of the slot (sections A and J) are vertically spaced away from the bottom wall 12 a greater distance than the middle section (sections D–G) such that the slot forms an upwardly opening configuration when viewed from the center of the tray. It should be noted that the slot could be formed in a reverse fashion to have a downwardly opening configuration in which the ends of the slot (sections A and J) are closer to the bottom wall 12 and the middle section (sections D–G) is at or slightly below the upper edge of the side wall. In this case, the middle section would support an intermediate portion of the shouter above its bottom edge.

As previously mentioned, the sections A–J alternate in angular direction, and are generally equal in angular direction and length, so that overall the slot 22 from end to end is straight, running along a chord of the tray 10. Thus, the shouter card 30, FIGS. 8–13, remains generally straight when inserted in the slot 22, without any noticeable deformation, being secured between the peaks of the opposite side walls of the slot 22. This enables the slot 22 to in accommodate and securely receive a wider range of shouter card thicknesses.

Figure 9:
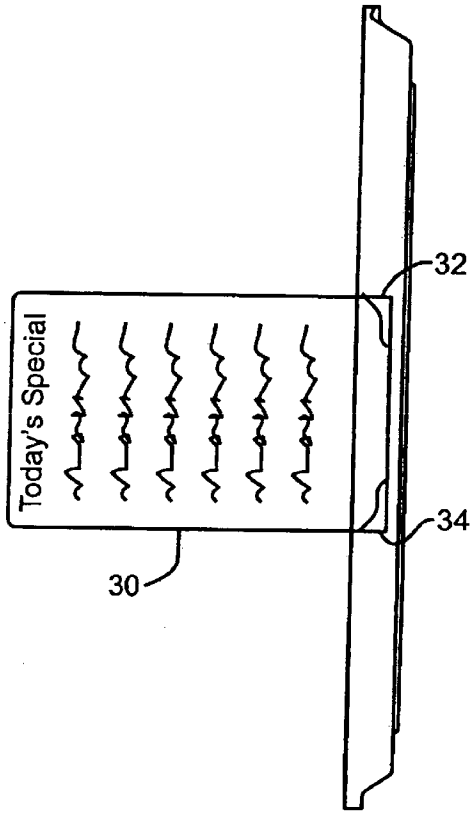
FIG. 9 is a view like FIG. 2 with the shouter inserted in the slot.
Figure 8:
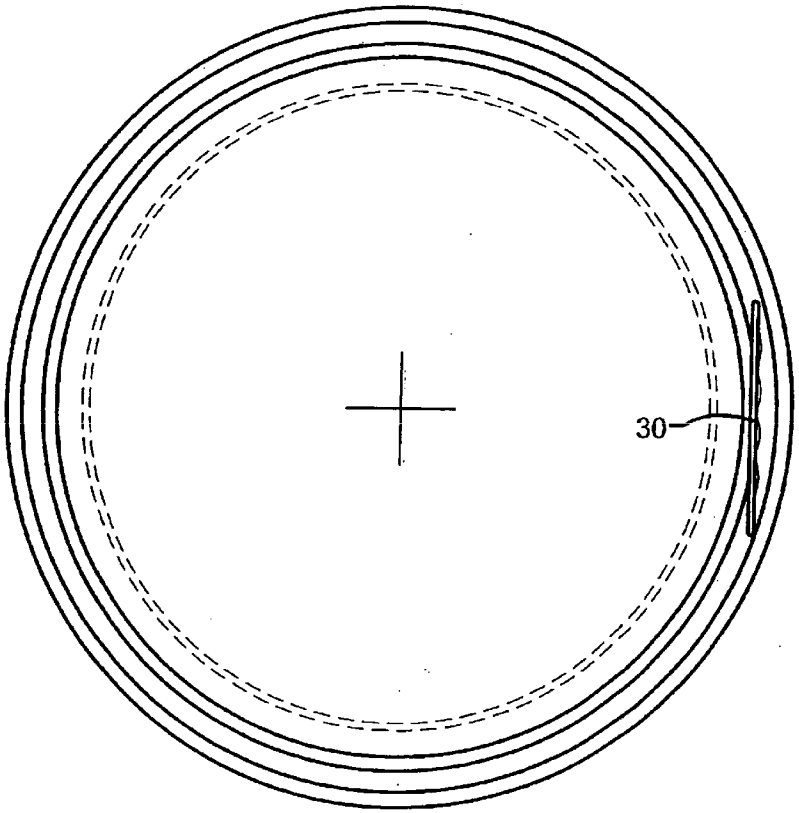
FIG. 8 is a view like FIG. 1 but with the shouter inserted in the slot.
Figure 12:
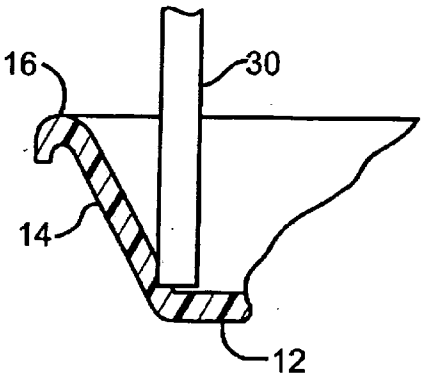
FIG. 12 is a view like FIG. 6 with the shouter inserted in the slot.
Figure 13:
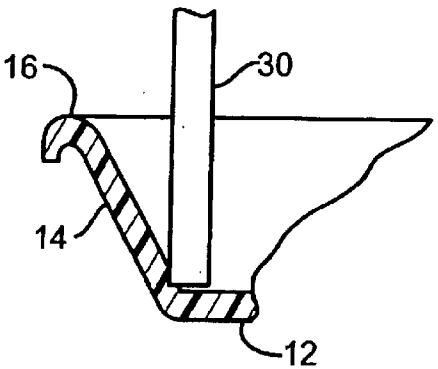
FIG. 13 is a view like FIG. 5 with the shouter inserted in the slot.
Figure 10:
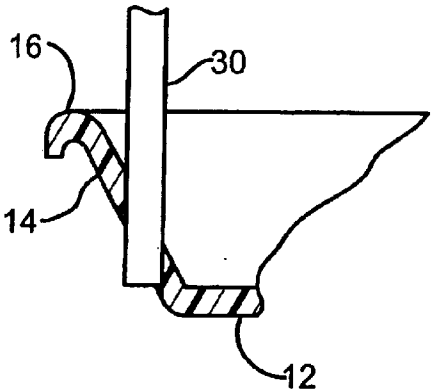
FIG. 10 is a view like FIG. 3 with the shouter inserted in the slot.
Figure 11:
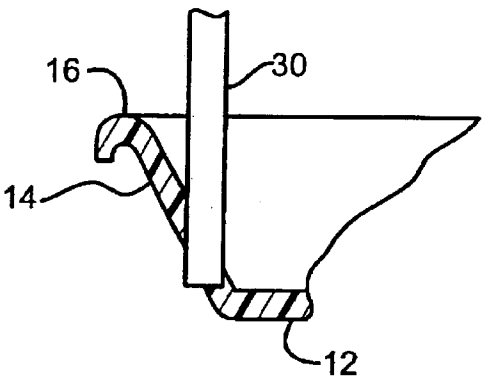
FIG. 11 is a view like FIG. 4 with the shouter inserted in the slot.

Referring to FIG. 9, the lower corners 32 and 34 of the shouter card 30 are on the outside of the side wall 14 of the tray 10 and the shouter card 30 extends upwardly therefrom with it extending through the side wall 14 at the ends of the slot 22 and being supported from the bottom in the middle of the slot 22. The thickness of the shouter card 30 is preferably such that a light friction fit exists between the side walls of the slot 22 and the card 30. Using the dimensions as stated above, the card 30 may be on the order of about 1/16 inch in thickness and be made of a relatively rigid plastic material.

Figure 15:
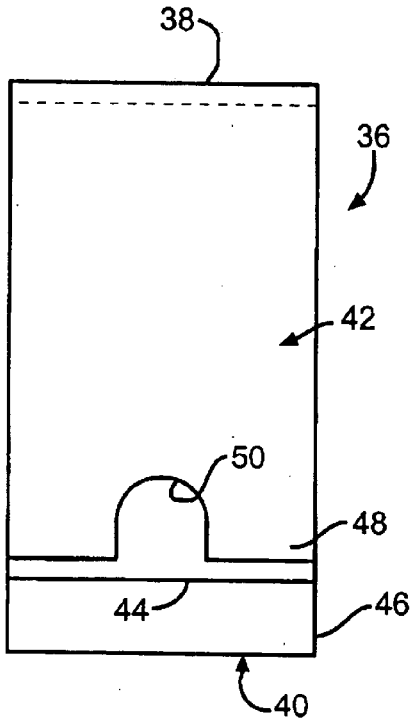
FIG. 15 is a rear plan view of the shouter of FIG. 14.
Figure 14:
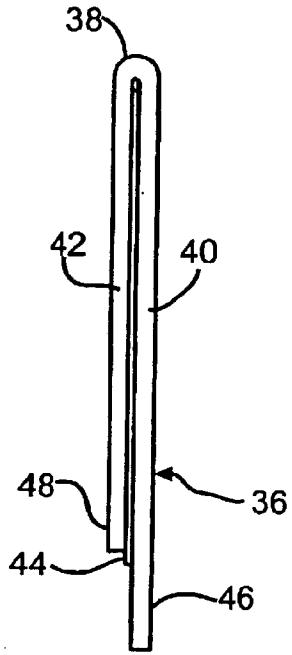
FIG. 14 is a side plan view of an alternate type of shouter card usable with the present invention.

Alternatively, a shouter card 36 (FIGS. 14 and 15) may be provided which is a transparent plastic sheet which is folded over on itself at the top end 38 as shown so that a paper or other thin shouter card 44 may be placed in a pocket defined by the two walls 40, 42 of the folded over plastic so that the information on the shouter card 36 can be easily changed. At the bottom 46 of such a transparent shouter card 36, one wall 40 may extend further downwardly than the base 48 of the other wall 42 so that only one thickness of the shouter card 36 is actually received by the slot 22.

Alternatively, the shouter could be a piece of stiff paper or paper board which could be inserted in the slot 22. Preferably, the shouter is resistant to soaking up liquids and is cleanable.

Figure 17:
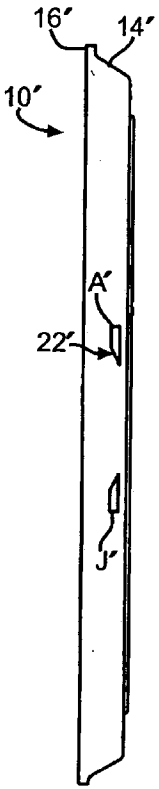
FIG. 17 is a side plan view of the tray of claim 16.
Figure 16:
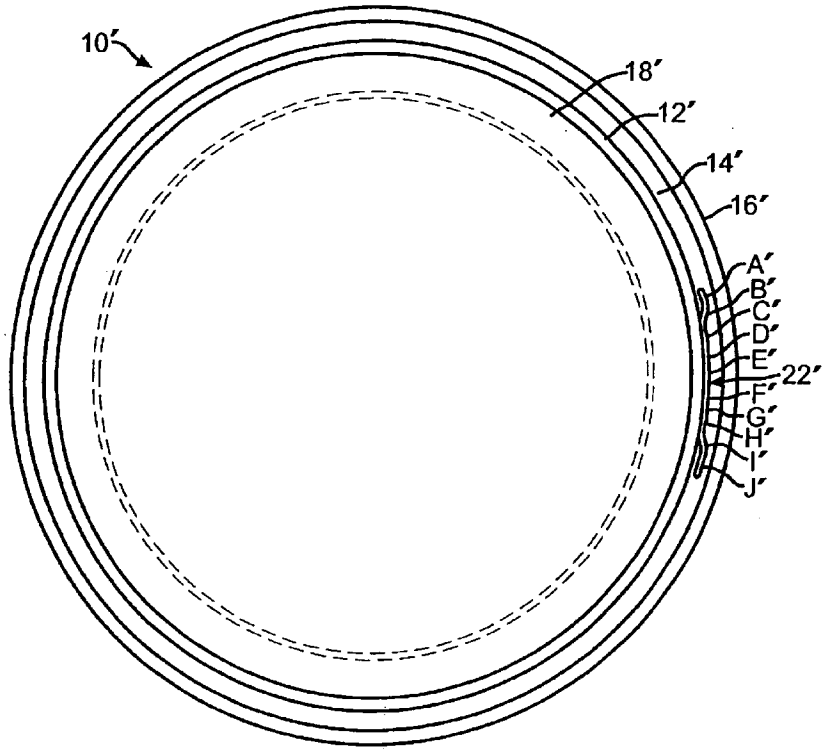
FIG. 16 is a top plan view of an alternate embodiment of a tray having a slot of a different configuration.
Figure 18:
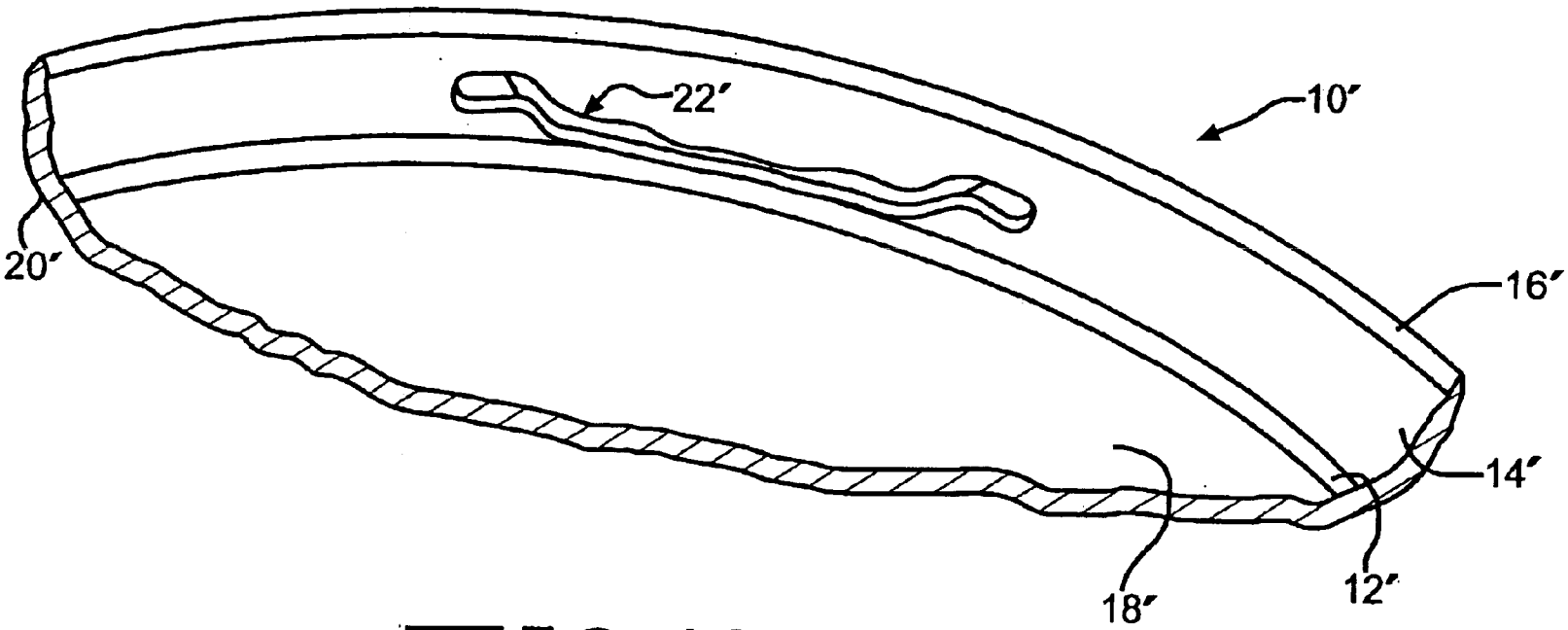
FIG. 18 is a partial perspective view showing the slot of the tray of FIG. 16.

FIGS. 16–18 show an alternate embodiment of the tray, denoted 10'. Like the above described embodiment, the tray 10' has a bottom wall 12' with a circular bottom rib 20' at its bottom, an angled side wall 14' with a rim 16' at the top of the side wall 14' and a non-skid pad 18' applied to the top surface of the bottom wall 12'. The side wall 14' includes a slot 22' cut into the slide wall 14' along a line forming a chord of the circular side wall 14'. Also like the above described embodiment, the slot 22' is made up of end to end joined segments A'–J' alternating from adjacent segment to adjacent segment, with only the three segments at each end of the slot 22' (segments A'–C' and segments H'–J') having two sides at right angles to the bottom wall 12' of the tray 10' and the four middle segments (segments D–G') having only a outer side supporting the shouter card. Also like the first embodiment, the ends of the slot (sections A' and J') are vertically spaced away from the bottom wall 12' a greater distance than the middle (sections D'–G') such that the slot forms an upwardly opening configuration when viewed from the center of the tray so as to hold the shouter card in an upright orientation.

This embodiment of the tray 10' differs from the above embodiment in the configuration of the slot 22', in particular the two segments at each end of the slot 22' (A' and B' and I' and J') are oriented differently. The segments second from the ends (segments B' and I') are angled more sharply away from the bottom wall 12' and the outer two segments (segments A' and J') are flatter and in fact angled slightly downwardly from respective segments B' and I'. This configuration results in the ends of the slot 22' being spaced vertically downwardly from the upper edge of the side wall 14' a greater distance than the first embodiment, such that there is more side wall 14' material above the slot 22' at its ends. The increased side wall material between the slot 22' and the upper edge may increase the strength of the side wall 14' at the slot 22' so as to better resist bending of the side wall 14' at the slot 22' when the tray 10' is loaded. Also, since the ends of the slot are horizontal, they extend for a wider included angle and so increase the frictional holding force of the shouter card in the slot.

Preferred embodiments of the invention have been described in considerable detail. Many modifications and variations to the preferred embodiments described will be apparent to those skilled in the art. Therefore, the invention should not be limited to the embodiment described, but should be defined by the claims which follow.

I claim:

1. A serving tray having a bottom wall and a side wall that angles outwardly from said bottom wall, said side wall having a generally vertical slot defined by at least four end to end joined alternating angle segments extending between ends of said slot, said ends of said slot extending through said side wall and having an open bottom a middle section of said slot having a closed bottom. said slot being sized to receive a shouter card for insertion into said slot and supported therein by said side wall.

2. The tray of claim 1, wherein said slot is generally straight.

3. The tray of claim 1, wherein said bottom wall is round and said side wall is frusto-conical.

4. The tray of claim 3, wherein said bottom wall is circular.

5. The tray of claim 4, wherein said slot extends generally straight along a chord of said circular bottom wall.

6. The tray of claim 1, wherein said slot is at an edge of said bottom wall.

7. The tray of claim 1, wherein both bottom corners of said shouter can extend through said side wall so as to project on an outside of said side wall.

8. The tray of claim 1, wherein aid middle section of said slot is open on an inner side thereof.

9. The tray of claim 1, wherein said slot is inside of an outer rim of said tray.

10. The tray of claim 1, wherein said middle section has opposite ends spaced from said bottom wall different distances than said middle section.

11. The tray of claim 10, wherein said opposite ends are at a greater distance from said bottom wall than said middle section.

12. The tray of claim 1, further including a shouter.

13. The tray of claim 12, wherein said shouter is rectangular and includes a cover defining a pocket in which said shouter card is disposed and having a bottom edge sized to fit into said slot.

14. The tray of claim 13, wherein said cover is transparent.

15. The tray of claim 14, wherein said cover is plastic.

16. The tray of claim 13, wherein said cover includes a first wall and a second wan spaced from said first wall, wherein at least one edge of said second wall is free from said first wall.

17. The tray of claim 16, wherein said first wall is joined to said second wall along a top edge and said first wall has a bottom edge that extends downwardly beyond a bottom edge of said second wall, wherein said first wall bottom edge is sized to be received in said slot in a friction fit.

* * * * *